US007193513B2

(12) United States Patent
Iwasawa

(10) Patent No.: US 7,193,513 B2
(45) Date of Patent: Mar. 20, 2007

(54) ALARM SYSTEM

(75) Inventor: Masashi Iwasawa, Ohtsu (JP)

(73) Assignee: Optex Co., Ltd., Shiga (JP)

( * ) Notice: Subject to any disclaimer, the term of this patent is extended or adjusted under 35 U.S.C. 154(b) by 0 days.

(21) Appl. No.: 11/312,572

(22) Filed: Dec. 21, 2005

(65) Prior Publication Data

US 2006/0097865 A1 May 11, 2006

Related U.S. Application Data

(63) Continuation of application No. 10/246,522, filed on Sep. 19, 2002.

(51) Int. Cl.
*G08B 1/08* (2006.01)

(52) U.S. Cl. ..... 340/539.1; 340/309.16; 340/540; 340/541; 702/187

(58) Field of Classification Search ..... 340/541, 340/539.1, 539.13, 539.16, 539.17, 572.1; 702/187

See application file for complete search history.

(56) References Cited

U.S. PATENT DOCUMENTS

| | | | | |
|---|---|---|---|---|
| 3,848,231 | A | 11/1974 | Wootton | 340/524 |
| 4,347,501 | A | 8/1982 | Akerberg | 340/539.13 |
| 4,623,876 | A | 11/1986 | Shima et al. | 340/539.1 |
| 4,772,876 | A | 9/1988 | Laud | 340/539.22 |
| 4,797,663 | A | 1/1989 | Rios | 340/691.6 |
| 5,155,469 | A | 10/1992 | Hartmann et al. | 340/539.17 |
| 5,559,496 | A | 9/1996 | Dubats | 340/539.26 |
| 5,570,079 | A | 10/1996 | Dockery | 340/541 |
| 5,638,046 | A | 6/1997 | Malinowski | 340/539.17 |
| 6,353,390 | B1 * | 3/2002 | Beri et al. | 340/572.1 |
| 6,473,688 | B2 * | 10/2002 | Kohno et al. | 701/117 |
| 6,661,340 | B1 | 12/2003 | Saylor et al. | 340/517 |
| 2005/0154598 | A1 * | 7/2005 | Kanayama et al. | 705/1 |

FOREIGN PATENT DOCUMENTS

| | | |
|---|---|---|
| FR | 2 748 340 | 11/1997 |
| JP | 8-69590 | 3/1996 |
| JP | 408069590 | 3/1996 |
| JP | 11-272970 | 10/1999 |

* cited by examiner

*Primary Examiner*—Jeffery Hofsass
*Assistant Examiner*—Anne V. Lai
(74) *Attorney, Agent, or Firm*—Wenderoth, Lind & Ponack, L.L.P.

(57) ABSTRACT

A transmitter comprises a signaling history information transmission unit. After the transmitter generates a detection signal, the signaling history information transmission unit sends corresponding signaling history information to a regular signal transmission unit. From this regular signal transmission unit, the signaling history information and a regular signal are transmitted to a receiver. The signaling history information contains a count value which is updated at every transmission of the information. Even if the transmitter generates a detection signal during a communication failure, the receiver can identify a time when the transmitter generated the detection signal, based on a received count value.

4 Claims, 4 Drawing Sheets

ALARM SYSTEM

This application is a continuation of U.S. application Ser. No. 10/246,522, filed Sep. 19, 2002.

BACKGROUND OF THE INVENTION

The present invention relates to an alarm system which produces an alarm signal when it detects an intruder in an office, factory, and the like (e.g. the alarm system reports such event to a security company). In particular, the present invention relates to a measure for ensuring transmission of such an alarm signal, even if an intruder is detected during a communication failure or the like.

Regarding an alarm system which produces an alarm signal on detecting an intruder in an office, factory, and the like, a conventional system is equipped with a transmitter which generates a detection signal on detection of an intruder in its monitoring area, and a receiver which reports to a security company (i.e. produces an alarm signal) on receiving the detection signal from the transmitter.

The transmitter is a passive infrared sensor or an active infrared sensor (infrared beam interruption sensor). The passive infrared sensor detects far-infrared rays emitted from a person who enters its monitoring area, and produces a detection signal when an amount of detected rays exceeds a predetermined threshold level. For another, the active infrared sensor is provided with an emitter containing an emitting element and a receiver containing a receiving element. With the emitter and the receiver being disposed face to face across a monitoring area, the emitter projects a near-infrared beam toward the receiver. If the near-infrared beam directed from the emitter to the receiver is interrupted by an intruder, and thus an amount of beam received by the receiving element changes, the sensor produces a detection signal.

There is a different type of alarm system which utilizes a polling system. As illustrated in FIG. 3, a plurality of active infrared sensors 4, 4, 4 is provided such that a detection signal can be transmitted between respective infrared sensors 4, 4. According to the polling system, when any of the infrared sensors 4 detects a person and produces a detection signal, the signal is successively transmitted to the infrared sensor(s) 4 located downstream along a direction of transmission. Finally, from the infrared sensor 4 which is located at a downstream end along the transmission direction, the detection signal is sent to a receiver 2.

Concerning the above-mentioned alarm systems, however, if a transmission circuit of the transmitter fails or if it is adversely affected by a noise while transmitting a detection signal, the detection signal may not be received by the receiver. Besides, in the case of the polling system, the transmission line of a detection signal is interrupted, if a communication failure occurs temporarily in one of active infrared sensors, or if any of the active infrared sensors is temporarily suspended in an artificial manner. As long as the transmission line remains interrupted, any detection signal produced by a sensor which is located upstream of an interrupted position in the transmission line fails to reach the receiver.

In this situation, by the time a normal communication state is recovered between the transmitter and the receiver, it is often a case that the transmitter has finished transmission of a detection signal. Under such circumstances, the receiver never recognizes that the transmitter detected an intruder. To summarize, if a person enters a monitoring area during communication failure, and the like, the alarm system cannot recognize the intruder and cannot ensure a reliable operation.

The present invention is made in view of such drawbacks. With regard to an alarm system composed of a transmitter and a receiver, and producing an alarm signal when the receiver receives a detection signal from the transmitter, the present invention intends to provide an alarm system in which an alarm signal can be produced with certainty even in an event of a communication failure between the transmitter and the receiver.

SUMMARY OF THE INVENTION

To achieve the above object, an alarm system of the present invention is based on an alarm system having a transmission system which generates a detection signal upon detection of an object in a monitoring area, and a receiving system which generates an alarm signal on receiving the detection signal from the transmission system. In the alarm system of the present invention, the transmission system is provided with a device for transmitting signaling history information. After the transmission system generates a detection signal upon detection of an object, this signaling history information transmission device produces, at a predetermined time interval, signaling history information which relates to when the detection signal is generated, and allows the signaling history information to be received by the receiving system.

In an event of a communication failure, and the like, if the transmission system generates a detection signal upon detection of an object, the receiving system may not be able to recognize the detection signal. Even in this situation, the above alarm system arranges the signaling history information transmission device to produce, at a predetermined time interval, signaling history information which relates to a time when the detection signal is generated. Therefore, after the failure is recovered, the receiving system can receive the signaling history information, based on which the receiving system can recognize a previous signaling operation and produce an alarm signal. Namely, the receiving system never misses any signaling operation during the communication failure, thereby producing an alarm signal without fail. This alarm system exhibits remarkable reliability.

In a preferable arrangement, signaling history information relates to when a detection signal is generated or how many times the signaling history information is transmitted. As a result, the receiving system can, easily and accurately, identify a time when the transmission system previously generated a detection signal. In addition, this arrangement enables the receiving system to compare a time when an alarm signal is produced, with signaling history information received by the receiving system. Thereby, the receiving system can determine whether it has produced an alarm signal in response to particular signaling history information.

The transmission system may comprise a device for transmitting a regular signal to the receiving system at a predetermined time interval. Besides, this regular signal transmission device may be arranged to receive signaling history information from the signaling history information transmission device, and to send the signaling history information and the regular signal to the receiving system. Because of this arrangement, signaling history information can be sent to the receiving system, with use of the regular signal transmission device which is conventionally included in a transmission system of an alarm system. Namely, this regular signal transmission device serves not only as a source for transmitting a regular signal but also as a source for transmitting signaling history information. Hence, the transmission system can achieve the above operations without complicating its structure.

In such an arrangement, the regular signal transmission device may be arranged to send a regular signal at a shorter interval, if the signaling history information transmission device starts transmission of signaling history information. According to this arrangement, the signaling history information can be sent to the receiving system also at a shorter interval, so that the receiving system can receive the signaling history information substantially at the same time with recovery of a normal communication state. Consequently, the receiving system can quickly recognize a previous signaling operation by the transmission system.

With respect to the above arrangements, the signaling history information transmission device may be arranged to end transmission of signaling history information, after it sends the signaling history information for a predetermined period of time or a predetermined number of times. This arrangement prevents transmission of signaling history information which is likely to have been received by the receiving system. Namely, this arrangement avoids transmission of unnecessary signaling history information, and reduces an amount of signaling history information data to be transmitted from the transmission system. Further regarding the above arrangements, the signaling history information transmission device may be arranged to supply the receiving system with signaling history information which relates to all detection signals previously generated by the transmission system. According to this arrangement, signaling history information can be sent to the receiving system without omission, thus allowing the receiving system to recognize an entire signaling history in the transmission system.

Alternatively, the signaling history information device may be arranged to supply the receiving system with signaling history information which relates to an oldest detection signal from among detection signals previously generated by the transmission system. In a case where a plurality of detection signals have been generated by the transmission system, this arrangement allows the receiving system to identify a time when an oldest (hence considered significant) signal was generated.

Accordingly, it is possible to acquire effective information, with a minimum amount of data transmission from the transmission system.

DETAILED DESCRIPTION OF THE PREFERRED EMBODIMENTS

Embodiments of the present invention are hereinafter described with reference to the drawings. In the following embodiments, the present invention is applied to a security system or the like which is installed for nighttime security in an office, factory, and the like, and which serves to detect an intruder who enters its monitoring area.

(First Embodiment)

A first embodiment is arranged to detect an intruder in a monitoring area, with use of an active infrared sensor.

Figure 1:
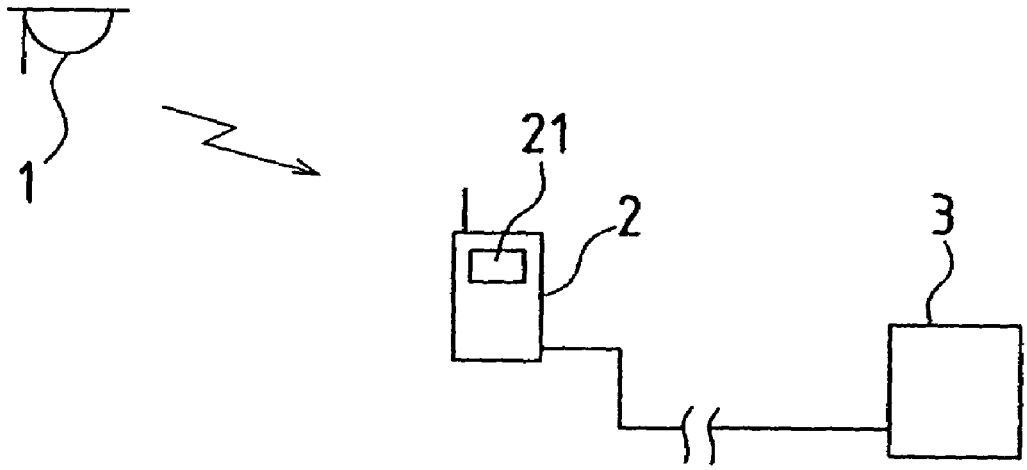
FIG. 1 schematically shows a configuration of an alarm system of a first embodiment.

FIG. 1 schematically shows a configuration of an alarm system of this embodiment. As illustrated, this alarm system is composed of a transmitter 1 (as a transmission system) which is constituted from a passive infrared sensor unit and a radio transmission unit, and a receiver 2 (as a receiving system) which receives a radio detection signal from the transmitter 1. This is a simplex communication system in which signals can flow only from the transmitter 1 to the receiver 2. The receiver 2 is connected, for example, with a management server 3 at a security company. When a detection signal is sent from the transmitter 1, the receiver 2 reports detection of a person (i.e. sends an alarm signal) to the management server 3.

Figure 2:
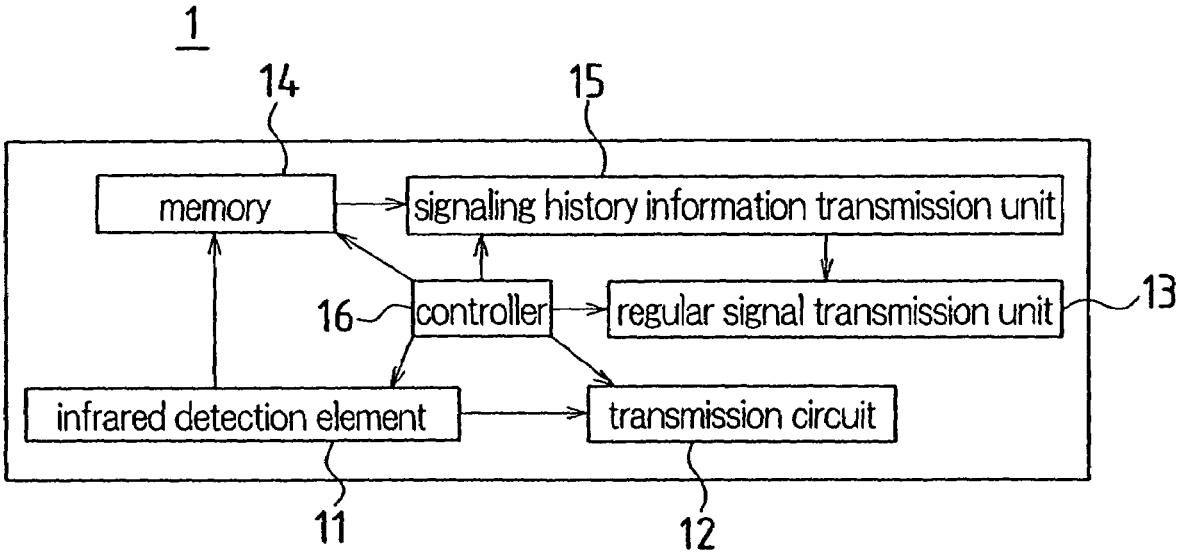
FIG. 2 is a block diagram of circuitry of a transmitter of the alarm system of the first embodiment.

FIG. 2 is a block diagram showing circuitry of the transmitter 1. As illustrated, the transmitter 1 includes an infrared detection element 11, a transmission circuit 12, a regular signal transmission unit 13, a memory 14, a signaling history information transmission unit 15 and a controller 16.

The infrared detection element 11 is for example, a pyroelectric element. In a predetermined monitoring area, the infrared detection element 11 detects an infrared ray emitted from a person or the like, and produces a signal when an amount of received infrared ray exceeds a predetermined threshold level. In response to a signal generated by the infrared detection element 11, the transmission circuit 12 sends a detection signal to the receiver 2.

The regular signal transmission unit 13 sends a regular signal (a supervised signal) to the receiver 2 at a certain time interval. Normal operation of the alarm system is confirmed by constant receipt of regular signals by the receiver 2. Namely, a state where the receiver 2 does not receive a regular signal can be determined as a system failure (failure of the transmitter 1 or the receiver 2, or a communication failure). In this case, the receiver 2 sends a failure signal to the management server 3.

When the infrared detection element 11 generates a signal, the memory 14 acquires and stores signaling information about a signaling operation by the infrared detection element 11. This storage operation is carried out every time the infrared detection element 11 generates a signal. Accordingly, the memory 14 accumulates information about a history of previous signaling operations performed by the infrared detection element 11.

As mentioned above, a detection signal is sent from the transmission circuit 12 to the receiver 2, in response to a signaling operation performed by the infrared detection element 11. Thereafter, the signaling history information transmission unit 15 transmits, at a certain time interval, signaling history information which relates to a time when this detection signal is generated. To be specific, the unit 15 reads information stored in the memory 14 and sends the signaling history information to the regular signal transmission unit 13 at a constant time interval. In other words, if the memory 14 stores information about a previous signaling operation performed by the infrared detection element 11, the unit 15 sends the information to the regular signal transmission unit 13 at a constant time interval.

Additionally, the signaling history information transmission unit 15 has a built-in counter. Every time the signaling history information transmission unit 15 sends signaling history information to the regular signal transmission unit 13, the unit 15 updates a count value (i.e. information as to how many times the signaling history information has been sent) which is added to the signaling history information. Thereby, the signaling history information sent to the regular signal transmission unit 13 contains a count value which is updated at every transmission of the information. This signaling history information is then transmitted to the receiver 2, together with a regular signal from the regular signal transmission unit 13.

In addition, when the count value reaches "100", the signaling history information transmission unit 15 ends transmission of the signaling history information. To give an example, after the infrared detection element 11 generates a signal (a first signaling operation), a series of relevant signaling history information which contain an increasing count value is sent to the receiver 2 at a certain time interval. In this situation, it is supposed that the infrared detection element 11 produces another signal (a second signaling operation) when the transmission count of the signaling history information is "50". Then, the signaling history information transmission unit 15 simultaneously sends signaling history information with count "51" (which relates to the first signaling operation performed by the infrared detection element 11) and signaling history information with the count "1" (which relates to the second signaling operation performed by the infrared detection element 11). Later, when the count value of the former signaling history information reaches "100", the unit 15 ends transmission of the former signaling history information, and continues to transmit only the latter signaling history information. When transmission of the former signaling history information ends at the count "100", the latter signaling history information carries the count "50". Of course, the count value for discontinuing transmission of the signaling history information need not necessarily be "100", but may be optionally set to any value.

CPU 16 is in charge of comprehensive management and control over elements 11–15 of the transmitter 1.

The receiver 2 includes a receiver unit (not shown) for receiving signaling history information. When this receiver unit recognizes signaling history information, the receiver 2 can recognize a previous signaling operation performed by the infrared detection element 11, and identify how many signals were generated and when each such signal was generated. For example, while the regular signal transmission unit 13 is set to produce a regular signal every minute, the infrared detection element 11 is assumed to have generated two signals in the manner mentioned above. In this case, on receiving signaling history information with the count "51" and signaling history information with the count "1", the receiver 2 recognizes that the infrared detection element 11 generated a signal (i.e. detected an intruder) twice, 51 minutes ago and 1 minute ago, respectively.

Incidentally, when the receiver 2 receives a detection signal from the transmitter 1, the receiver 2 reports to the management server 3 through a communication line (e.g. a public circuit). In addition, on receiving the signaling history information, the receiver 2 may inform the management server 3 of the count value. Accordingly, the security company can recognize a previous signaling operation performed by the infrared detection element 11, and identify how many signals were generated and when each such signal was generated.

The receiver 2 is also equipped with an LCD (Liquid Crystal Display) panel 21 for indicating receipt of a detection signal and signaling history information sent from the transmitter 1. As such a display panel, an LED (Light Emitting Diode) display may be used as well.

Operation of the alarm system of this constitution is described below. An operational feature of this system is observed when a person or the like enters a monitoring area during a communication failure between the transmitter 1 and the receiver 2. Therefore, the following description is focused on an operation under such circumstances.

If the transmission circuit 12 in the transmitter 1 fails, or if it is adversely affected by a noise while transmitting a detection signal, the detection signal is not received by the receiver 2.

Even in this situation, the signaling history information transmission unit 15 supplies the regular signal transmission unit 13 with a series of signaling history information containing an increasing count value which is updated at every transmission of the information. The regular signal transmission unit 13 receives the signaling history information, and sends it to the receiver 2 in synchronization with a transmission timing of the regular signal. The unit 15 continues transmission of the signaling history information until the count value reaches "100", that is, until the information is transmitted 100 times.

After communication between the transmitter 1 and the receiver 2 is resumed, the receiver 2 receives the signaling history information as well as the regular signal. Based on this information, the receiver 2 recognizes a previous signaling operation performed by the infrared detection element 11, and identifies how many signals were generated and when each such signal was generated. Then, through a communication line, the receiver 2 informs the management server 3 of detection of an intruder and the count value. As a result, a security company can recognize a previous signaling operation performed by the infrared detection element 11, and identify how many signals were generated and when each such signal was generated.

Thus, according to the alarm system of this embodiment, even in a case where the transmitter 1 generates a detection signal on detection of an intruder, but the receiver 2 cannot receive the signal due to a communication failure or some other reason, a series of signaling history information is produced at a certain time interval and received later by the receiver 2. Therefore, the receiver 2 can recognize, without omission, a signaling operation during a communication failure.

Moreover, in order to send signaling history information to the receiver 2, this alarm system makes effective use of the regular signal transmission unit 13, which is conventionally included in a transmission system of an alarm system. Hence, it is possible to send the signaling history information to the receiver 2, without complicating structure of the transmitter 1.

(Second Embodiment)

Figure 3:
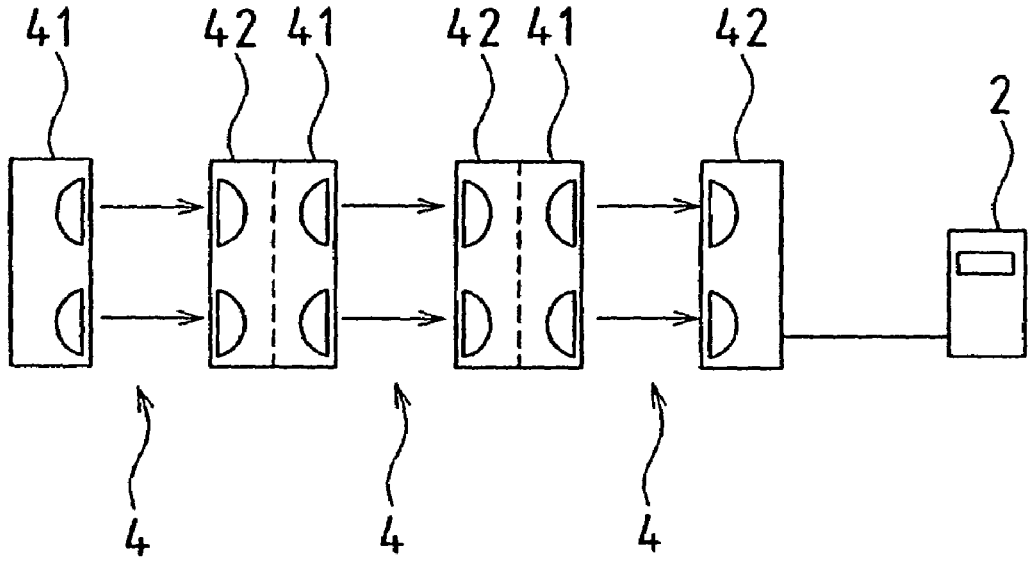
FIG. 3 schematically shows a configuration of an alarm system of a second embodiment.

Now, a second embodiment of the invention is described. In the second embodiment, the present invention is applied to an alarm system called a polling system. FIG. 3 schematically shows a configuration of this alarm system. As illustrated, this alarm system includes a plurality of active infrared sensors 4, 4, 4. To be specific, the active infrared sensors 4 are disposed to cover respective monitoring areas, with an emitter 41 and a receiver 42 of each sensor facing one another across its monitoring area. Regarding adjacent sensors 4, 4, the receiver 42 of one of the sensors and the emitter 41 of the other sensor are of integrated structure and connected such that a detection signal can be transmitted from the receiver 42 to the emitter 41. Each emitter 41, which emits an infrared pulse signal to a corresponding receiver 42, is arranged to be capable of adding a detection signal and signaling history information to the infrared pulse signal. Thus, when any of the infrared sensors 4 detects an intruder and generates a detection signal, the detection signal is successively transmitted to the infrared sensor(s) 4 located downstream along a direction of transmission (the right sensor(s) in the figure). Finally, from the infrared sensor 4 which is located at a downstream end of the transmission, the detection signal is sent to the receiver 2. In other words, a detection signal is transmitted downstream, along with a pulse signal of a near-infrared beam which is produced by each emitter 41.

Circuitry of the receiver 42 of each infrared sensor 4 includes transmission circuit 12, regular signal transmission unit 13, memory 14, signaling history information transmission unit 15 and controller 16, which are similar to those found in the transmitter 1 of the first embodiment. As functions of these devices are already mentioned in the first embodiment, detailed description is not repeated here. In this embodiment, the infrared sensors 4, 4, 4 constitute a transmission system as called in this invention.

The alarm system of the second embodiment operates in the following manner. When any of the infrared sensors 4 detects an intruder and generates a detection signal, the detection signal is successively transmitted to the infrared sensor(s) 4 located downstream along a transmission direction. However, if a communication failure occurs temporarily at one of active infrared sensors 4, 4, 4, or if any of the active infrared sensors 4 is temporarily suspended in an artificial manner, a transmission line of the detection signal is interrupted and thus the detection signal cannot be received by the receiver.

Even in this situation, the signaling history information transmission unit 15 produces a series of signaling history information containing an increasing count value which is updated at every transmission of the information, as is the case in the first embodiment. After a normal communication state is recovered, the signaling history information is successively transmitted to the infrared sensor(s) 4 located downstream along the transmission direction. Finally, in the infrared sensor 4 which is located at a downstream end of the transmission, the regular signal transmission unit 13 sends the signaling history information to the receiver 2 in synchronization with a transmission timing of a regular signal. Based on the signaling history information, the receiver 2 recognizes that any of the infrared sensors detected an intruder and generated a signal, and identifies how many signals were generated and when each such signal was generated. Then, through a communication line, the receiver 2 informs a management server 3 of detection of an intruder and a count value. As a result, a security company can recognize a signaling operation by any of the infrared sensors 4, and identify how many signals were generated and when each such signal was generated.

(Other Embodiments)

Figure 4:
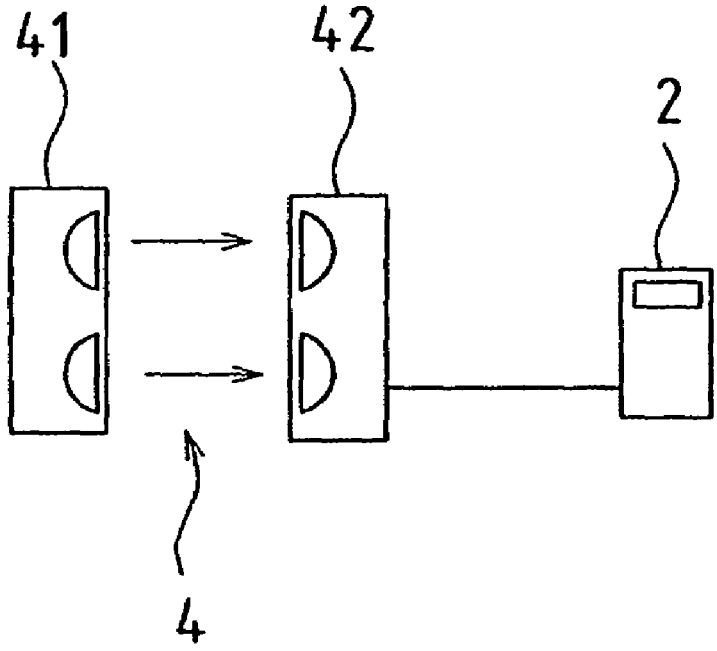
FIG. 4 schematically shows a configuration of an alarm system of a modification of the second embodiment.

In the above-mentioned second embodiment, the present invention is applied to a polling system in which a plurality of active infrared sensors are arranged in a communicable relationship. However, the present invention should not be limited to this arrangement. As illustrated in FIG. 4 which concerns a modification of the second embodiment, the invention is also applicable to an alarm system utilizing a single active infrared sensor 4. In this modified embodiment, receiver 42 has the same structure as the receiver of the infrared sensor which is located at the downstream end of the transmission, as adopted in the polling system of the second embodiment.

The polling system concerning the second embodiment is constituted from a combination of three active infrared sensors 4, 4, 4. However, the present invention should not be limited to this arrangement, and is still applicable where two or more than three active infrared sensors are used in combination.

In the first embodiment, the transmitter 1 and the receiver 2 are communicated by radio. Additionally, the present invention is applicable if the transmitter and receiver are communicated by wire. Likewise, regarding the second embodiment, communication between the infrared sensors 4, 4 may be established by radio.

As a manner of identifying a time when a detection signal is generated, the above embodiments utilize a count value which is added to signaling history information. Instead, a timer may be added to the transmitter 1 or each of the infrared sensors 4, so that signaling history information to be sent to receiver 2 can contain information about a time of a signaling operation.

As another arrangement, if signaling history information transmission unit 15 starts transmission of signaling history information, a regular signal may be sent at a shorter interval. According to this arrangement, signaling history information can be sent to receiver 2 also at a shorter interval, so that the receiver 2 can receive the signaling history information substantially at the same time with recovery of a normal communication state. Consequently, the receiver 2 can quickly recognize a previous signaling operation by the transmitter 1 or any of the infrared sensors 4.

As for a mode of transmitting signaling history information, it is not always necessary to synchronize transmission of the signaling history information with that of a regular signal. Instead, the signaling history information may be sent by a separate source for transmitting the signaling history information, at a different timing from a transmission timing of the regular signal.

As a manner of ending transmission of signaling history information, the above embodiments decide to terminate such transmission, depending on whether or not a count value reaches a predetermined value (100 in the above embodiments). Instead, transmission of the signaling history information may be discontinued when a total transmission time of the signaling history information amounts to a predetermined period of time.

In still another alternative, signaling history information to be sent to receiver 2 may relate to all detection signals previously generated in transmitter 1. In this case, the signaling history information can be sent to the receiver 2 without omission, thus allowing the receiver 2 to recognize an entire signaling history in the transmitter 1.

In yet another alternative, signaling history information to be sent to receiver 2 may relate only to an oldest detection signal from among detection signals previously generated by transmitter 1. In a case where a plurality of detection signals have been generated by the transmitter 1, this arrangement allows the receiver 2 to identify a time when an oldest (hence considered significant) signal was generated. Accordingly, it is possible to acquire effective information, with a minimum amount of data transmission from the transmitter 1.

What is claimed is:

1. An alarm system comprising:

a transmission system including (i) a transmission circuit for generating and transmitting a detection signal upon detection of an object within a monitoring area, and (ii) a transmission unit for (a) producing at a predetermined time interval, after said transmission circuit generates the detection signal upon detection of the object in the monitoring area, signaling historical information that directly relates to the detection signal, and (b) transmitting the signaling historical information independently of transmission of the detection signal by said transmission circuit; and a receiving system for receiving the signaling historical information when transmitted by said transmission unit, and for generating an alarm signal upon receiving the detection signal from said transmission circuit.

2. The alarm system according to claim 1, wherein said transmission unit is for producing signaling historical information that directly relates to the detection signal by producing signaling historical information that directly relates to the generation or transmission of the detection signal.

3. The alarm system according to claim 2, wherein said transmission unit is for producing signaling historical information that directly relates to the generation or transmission of the detection signal by producing signaling historical information that directly relates to the generation of the detection signal.

4. The alarm system according to claim 3, wherein said transmission unit is for producing signaling historical information that directly relates to the generation of the detection signal by producing signaling historical information that directly relates when the detection signal was generated by said transmission circuit.

* * * * *